US006719575B2

(12) United States Patent
Miyazaki

(10) Patent No.: US 6,719,575 B2
(45) Date of Patent: Apr. 13, 2004

(54) LEVER-TYPE CONNECTOR

(75) Inventor: Sho Miyazaki, Nagoya (JP)

(73) Assignees: Autonetworks Technologies, Ltd., Nagoya (JP); Sumitomo Wiring Systems, Ltd., Mie (JP); Sumitomo Electric Industries, Osaka (JP)

( * ) Notice: Subject to any disclaimer, the term of this patent is extended or adjusted under 35 U.S.C. 154(b) by 0 days.

(21) Appl. No.: 10/127,562

(22) Filed: Apr. 23, 2002

(65) Prior Publication Data

US 2002/0173184 A1 Nov. 21, 2002

(30) Foreign Application Priority Data

Apr. 24, 2001 (JP) ..... 2001-125533

(51) Int. Cl.[7] ..... H01R 13/62
(52) U.S. Cl. ..... 439/157
(58) Field of Search ..... 439/157, 372, 439/153, 152, 159–160

(56) References Cited

U.S. PATENT DOCUMENTS 5,476,705 A 12/1995 Mizuse et al.
5,609,494 A * 3/1997 Yamaguchi et al. ..... 439/157
5,904,583 A * 5/1999 Katsuma et al. ..... 439/157
5,913,691 A * 6/1999 Clark et al. ..... 439/157

* cited by examiner

*Primary Examiner*—Renee Luebke
*Assistant Examiner*—Felix O. Figueroa
(74) *Attorney, Agent, or Firm*—Oliff & Berridge, PLC

(57) ABSTRACT

In a state where a lever 20 is situated at its wait position in order to fit the present lever-type connector A with its mating connector B, the projecting end portions 22A of the arm parts 22 of the lever-type connector A projected from the operation part 21 face downward. In the two right and left end portions of the lower surface of a connector housing 10, there are disposed impact receive portions 19 which, in a state where the lever 20 is situated at its wait position, are projected downwardly of the projecting end portions 22A of the arm parts 22. When the lever-type connector A drops down in the posture that the projecting end portions 22A face downward, the impact receive portions 19 firstly collide with a drop surface G, so that most of the drop impact is received by the impact receive portions 19.

11 Claims, 9 Drawing Sheets

LEVER-TYPE CONNECTOR

BACKGROUND OF THE INVENTION

The present invention relates to a lever-type connector.

When a pair of connectors having a waterproof function and a shield function are fitted with each other and removed from each other by hand, not only a waterproofing seal ring disposed in one connector is slidingly contacted with the peripheral surface of the other connector to thereby produce frictional resistance, but also the outer peripheral surface of a shield shell disposed in one connector is slidingly contacted with the inner peripheral surface of a shield shell disposed in the other connector to thereby produce frictional resistance; and, these two kinds of frictional resistance impede the smooth fitting and removing operations of the two connectors.

In view of the above, in order to improve the operation efficiency of the fitting and removing operations of the two connectors, there is used a structure in which a lever is rotatably disposed in one connector, a cam pin is disposed in the other connector, the cam pin is engaged into a cam groove formed in the lever and, in the thus engaged state, the lever is rotated to thereby fit the two connectors with each other or remove them from each other. According to this structure, even when the rotation operation force is small, due to the cam action (leverage), a large fitting force or a large removing force can be applied to the two connectors.

As shown in FIGS. 8 and 9, in the case of the above-mentioned lever-type connector 100, a lever 102 of the connector 100 includes an operation part 103 formed narrow and long in the right and left direction thereof, and a pair of plate-shaped arm parts 104 respectively projected from the two end portions of the operation part 103, while there are formed two cam grooves 105 respectively in the two arm parts 104; and, two bearing holes 107 respectively formed in the two arm parts 104 are fitted with their associated support shafts 106 provided on and projected from the right and left outer side surfaces of a connector housing 101, whereby the lever 102 can be rotatably supported on the connector housing 101. When fitting this lever-side connector 100 with its mating connector (not shown), the lever 102 is positioned at a given wait position and the entrances of the cam grooves 105 are opened toward the cam pins (not shown) of the mating connector; and, in this state, the two connectors are moved closer to each other to thereby advance the cam pins into the entrances of the cam grooves and, in this state, the lever 102 is rotated.

When the lever 102 is present at the above wait position, there is a possibility that the projecting end portions 104A of the arm parts 104 respectively projected from the operation parts 103 can face downward depending on the fitting direction of the two connectors, the shapes of the cam grooves 105, and the shape of the connector housing 101.

When an operator carelessly slips his or her hands to thereby drop down the lever-type connector 100 onto a floor surface, in case where the lever-type connector 100 is inclined slightly, the projecting end portions 104A of the arm parts 104 firstly collide with the floor surface G and, therefore, the drop impact of the connector 100 due to the weight of the lever-side connector 100 and the weight of an electric wire connected to the lever-type connector 100 is wholly applied onto the arm parts 104. As a result of this, there is a fear that the lever 102 can be broken or the lever 102 can be removed from the support shafts 106.

Especially, when the lever-type connector is used in a circuit such as a power circuit in an electric car through which a large current flows, since a terminal metal member and an electric wire are thick and heavy in weight, the drop impact of the connector is great and thus the damage of the lever is great accordingly.

SUMMARY OF THE INVENTION

The present invention aims at eliminating the drawbacks found in the above-mentioned conventional lever-type connector. Accordingly, it is an object of the invention to provide a lever-type connector which can prevent the lever against damage when the connector drops down onto the floor.

According to a first aspect of the invention, there is provided a lever-type connector, wherein a lever including an operation part and a pair of arm parts respectively extended from the two ends of the operation part, the arm parts of the lever being supported respectively on the two right and left outer side surfaces of a connector housing; the lever is situated at its wait position, the entrances of cam grooves respectively formed in the arm parts are opened toward a mating connector, cam pins are respectively moved into the entrances of the cam grooves, and the lever is rotated, thereby fitting the lever-type connector with the mating connector; and, in a state where the lever is situated at the wait position, the projecting end portions of the arm parts projected from the operation part face downward, characterized in that, in the two right and left end portions of the lower surface of the connector housing, there are disposed impact receive portions which, in a state where the lever is situated at the wait position, are projected downwardly of the projecting end portions of the arm parts.

Also, according to a second aspect of the invention, in a lever-type connector as set forth in the first aspect of the invention, the impact receive portions are formed so as to be adjacent and opposed to the inner surfaces of the projecting end portions of the arm parts.

Further, according to a third aspect of the invention, in a lever-type connector as set forth in the first or second aspect of the invention, the impact receive portions are formed so as to fill up clearances existing respectively between the projecting end portions of the arm parts and the outer side surfaces of the connector housing.

According to a lever-type connector as set forth in the first aspect of the invention, when the present lever-type connector drops down in the posture that the lever is situated at the wait position and the projecting end portions of the arm parts face downward, the impact receive portions firstly collide with a drop surface and thus most of the drop impact of the lever-type connector is received by the impact receive portions. Therefore, there is hardly a possibility that the drop impact of the lever-type connector can be applied to the projecting end portions of the arm parts.

In case where the present lever-type connector drops down, there is a fear that, after the impact receive portions collide with the drop surface once, the lever-type connector can jump up and, when it drops down again, the projecting end portions of the arm parts can be butted against the drop surface or the projecting end portions of the arm parts can be butted against other members existing on the drop surface. However, according to the second aspect of the invention, since the impact receive portions are respectively disposed adjacent and opposed to the inner surfaces of the projecting end portions of the arm parts, even in case where the projecting end portions of the arm parts are going to flex toward the outer side surfaces of the connector housing, the projecting end portions are contacted with the impact receive portions, which prevents the projecting end portions from flexing greatly. Therefore, there can be eliminated the fear that the lever can be broken or can be removed from the connector housing due to the flexed projecting end portions of the arm parts.

As described above, in case where the present lever-type connector drops down, there is a fear that, after the impact receive portions collide with the drop surface once, the lever-type connector can jump up and, when it drops down again, the projecting end portions of the arm parts can be butted against the drop surface or the projecting end portions of the arm parts can be butted against other members existing on the drop surface. However, according to the third aspect of the invention, since the clearances respectively existing between the projecting end portions of the arm parts and the outer side surfaces of the connector housing are filled up by the impact receive portions, there is no fear that the projecting end portions of the lever can be flexed toward the side surface side of the connector housing. This can eliminate the fear that the lever can be broken or can be removed from the connector housing due to the flexed projecting end portions of the arm parts.

Figure 1:
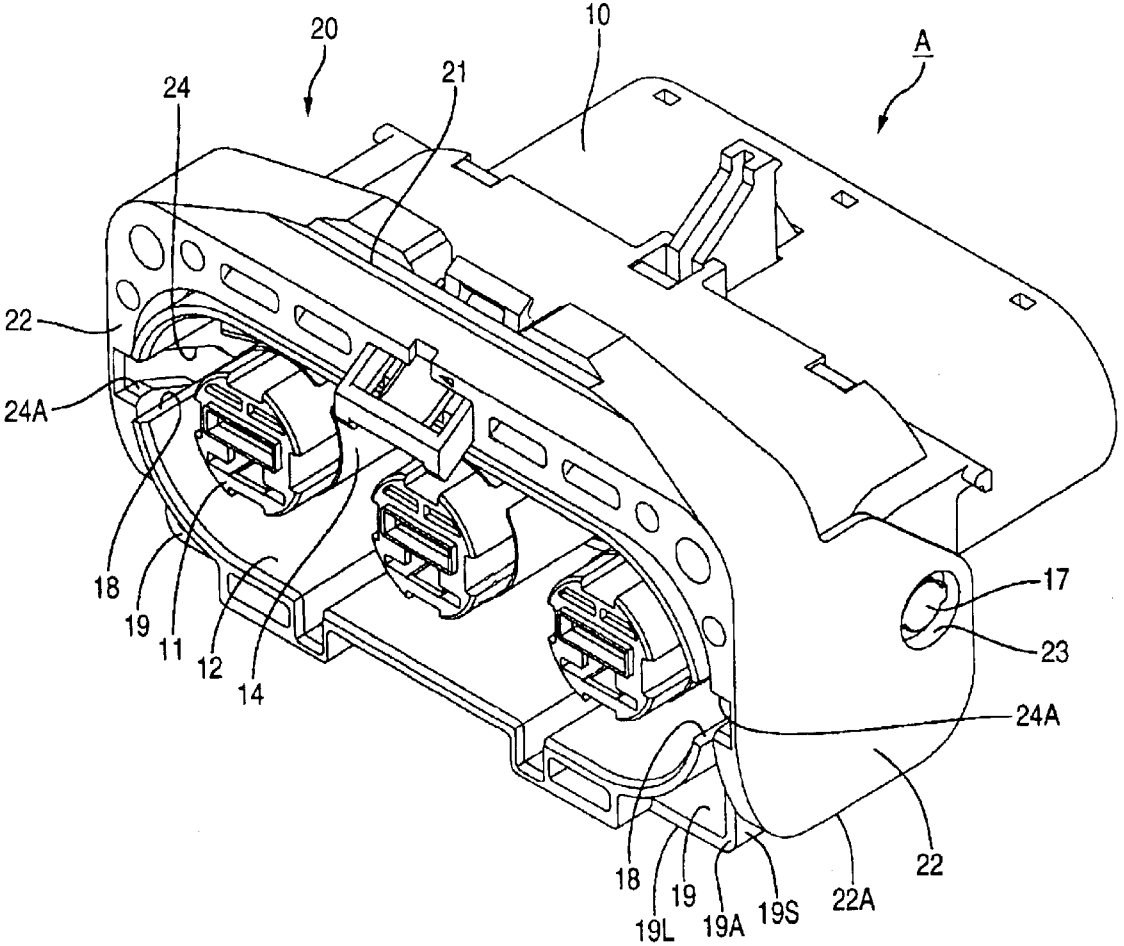
FIG. 1 is a perspective view of an embodiment 1 of a lever-type connector according to the invention, when it is viewed from the front surface thereof.
Figure 2:
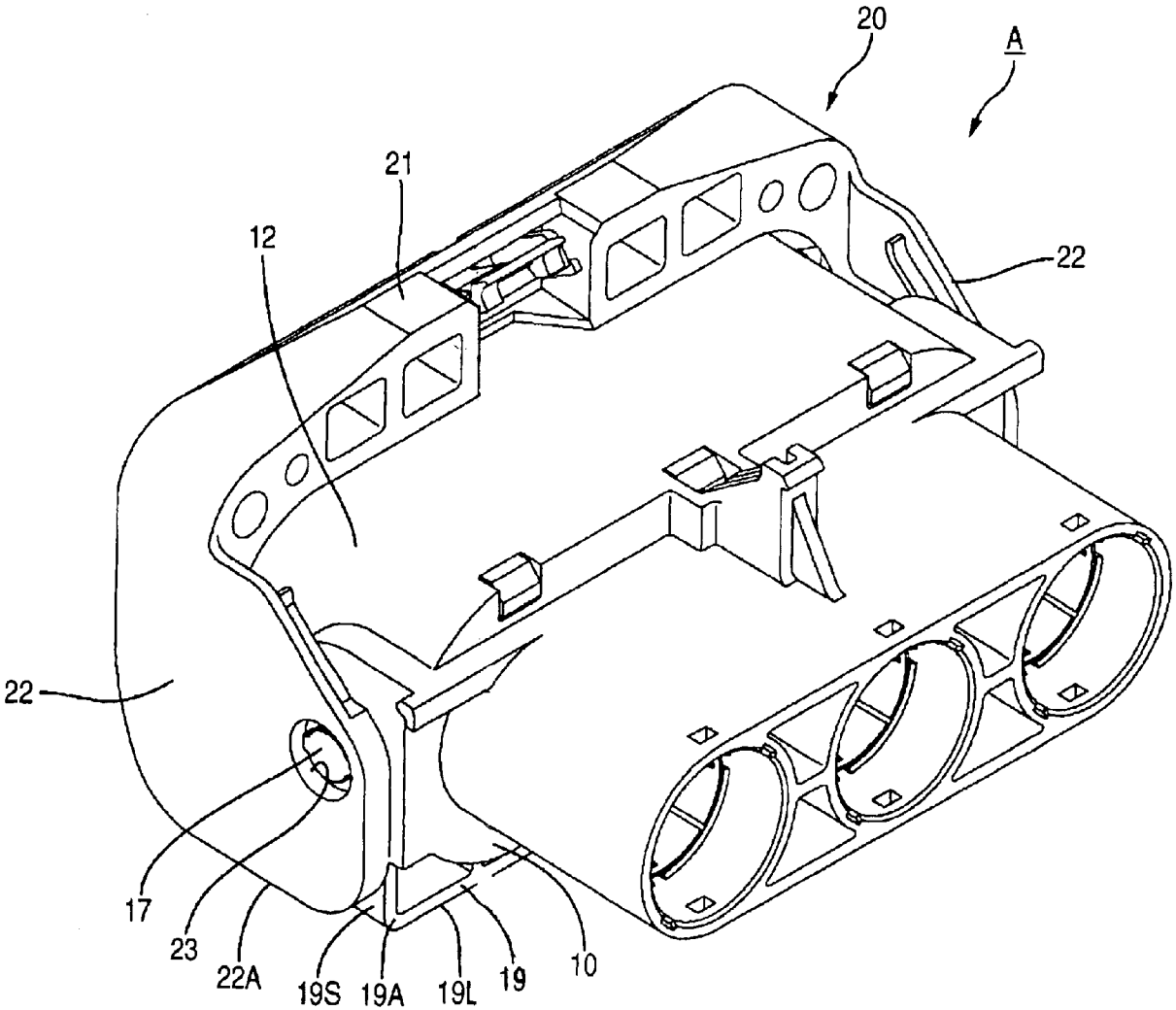
FIG. 2 is a perspective view of the embodiment 1, when it is viewed from the back surface thereof.

DETAILED DESCRIPTION OF THE PREFERRED EMBODIMENTS (Embodiment 1)

Now, description will be given below of an embodiment 1 of a lever-type connector according to the invention with reference to FIGS. 1 to 6.

The lever-type connector A according to the present embodiment comprises a connector housing 10 made of synthetic resin and a lever 20 made of synthetic resin.

In the connector housing 10, there are disposed three forwardly projecting circular-shaped terminal hold parts 11 arranged in the right and left direction (in the horizontal direction) of the connector housing 10, and a hood part 12 formed in an elliptical-like shape long in the horizontal direction for enclosing the three terminal hold parts 11 collectively. Within the three terminal hold parts 11, there are inserted female-terminal metal members 13 (see FIG. 4) from behind the terminal hold parts 11, respectively. Also, on the connector housing 10, there are mounted three shield shells 14 (see FIG. 3) each having a front end side portion divided into four pieces in the peripheral direction thereof in such a manner that the shield shells 14 extend along the outer peripheries of their respective terminal hold parts 11. The shield shells 14 enclose the female-terminal metal members 13 stored within the terminal hold parts 11 to thereby fulfill their respective shield functions. Also, on the deep-side end face of the hood part 12, there are projectingly formed three circular-shaped fitting barrel portions 15 (see FIG. 3) respectively concentric with their associated terminal hold parts 11; and, waterproofing seal rings 16 (see FIG. 3) are respectively fitted with the outer surfaces of the outer peripheries of their associated fitting barrel portions 15. Further, a pair of support shafts 17 are respectively provided on and projected from the right and left outer side surfaces of the hood part 12. In addition, in the hood part 12, there are disposed escape grooves 18 each formed by cutting the hood part 12 narrow and long backwardly from the front end edge of the hood part 12.

The lever 20 comprises an operation part 21 narrow and long in the right and left direction of the lever 20 and a pair of plate-shaped arm parts 22 which project in parallel to each other from the right and left end portions of the operation part 21, while the operation part 21 and the pair of arm parts 22 are molded into an integral unit. In the arm parts 22, there are formed bearing holes 23 respectively; and, in case where the bearing holes 23 are respectively fitted with their associated support shafts 17, the lever 20 can be rotatably mounted on the connector housing 10. Also, in the inner surfaces of the arm parts 22, there are formed cam grooves 24 respectively having their entrances 24A opened on the outer peripheral edges of the arm parts 22. Each of the cam grooves 24 has a substantially spiral shape with the bearing hole 23 of the arm part 20 as the center thereof, while each cam groove 24 approaches its associated bearing hole 23 as it goes toward the deep portion thereof.

A mating connector B is formed in a horizontally long elliptic shape which can be fitted with the lever-type connector A in such a manner that it extends along the inner periphery of the hood part 12. In the front surface (the surface that faces the lever-type connector A) of the mating connector B, there are formed three fitting recessed portions 30 into which the three fitting barrel portions 15 can be respectively fitted. In the process for fitting and removing the two connectors A and B with respect to each other, the seal rings 16 on the outer peripheries of the fitting barrel portions 15, while they are elastically flexed, are slidingly contacted with the inner peripheries of the fitting recessed portions 30. Also, in the interior portions of the respective fitting recessed portions 30, there are disposed shield shells 31 (see FIG. 3) which can be contacted with the outer surfaces of the shield shells 14 of the lever-type connector A. The inside diameter dimension of each of the shield shells 31 in the free state thereof is set smaller than the outside diameter of each of the shield shells 14 of the lever-type connector A. In the process for fitting and removing the two connectors A and B, the shield shells 31, while they are elastically flexed in the diameter enlarging direction thereof, are slidingly contacted with the shield shells 14 respectively. Also, on the right and left outer side surfaces of the mating connector B, there are projectingly provided a pair of cam pins 32.

Figure 3:
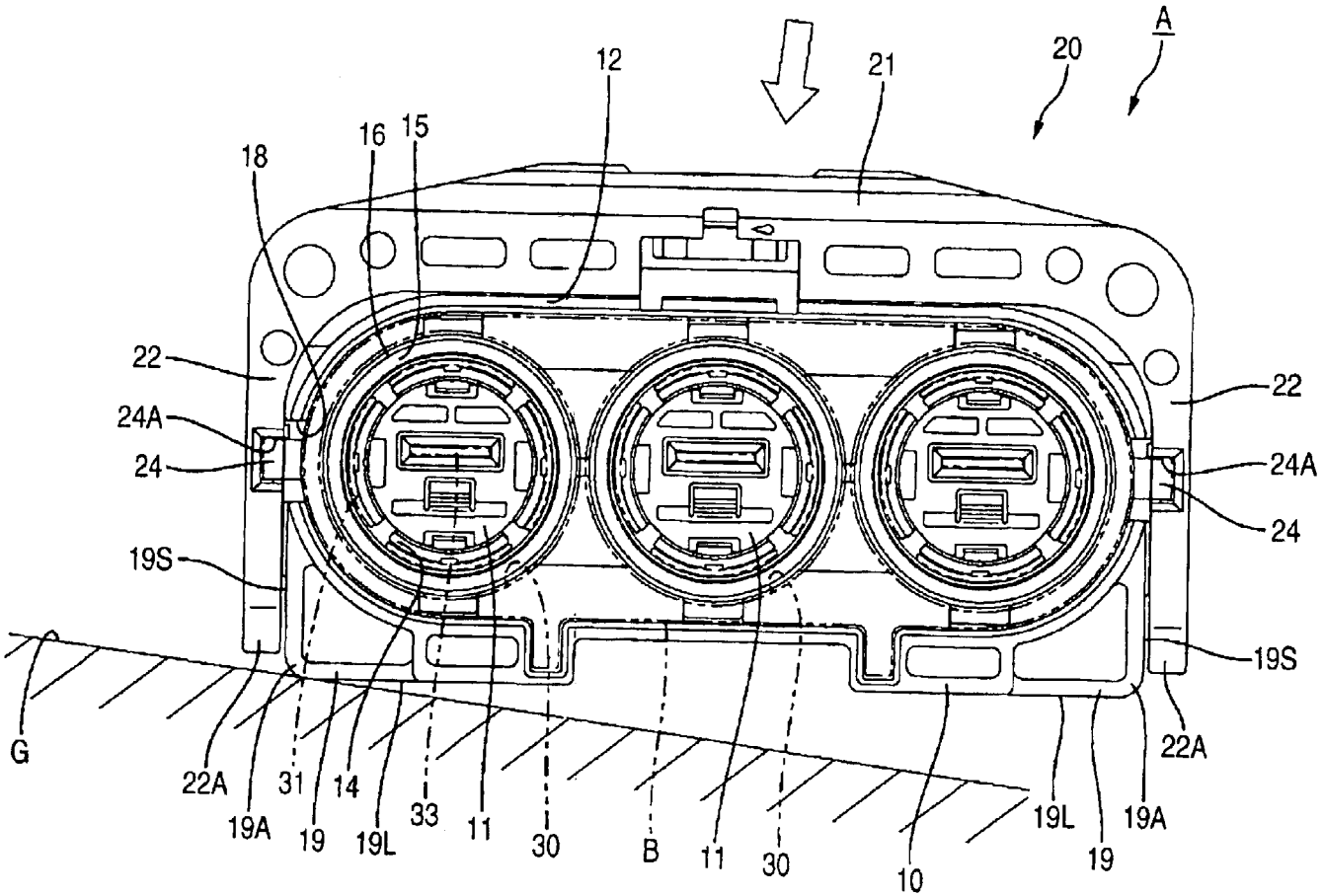
FIG. 3 is a front view of the embodiment 1.
Figure 4:
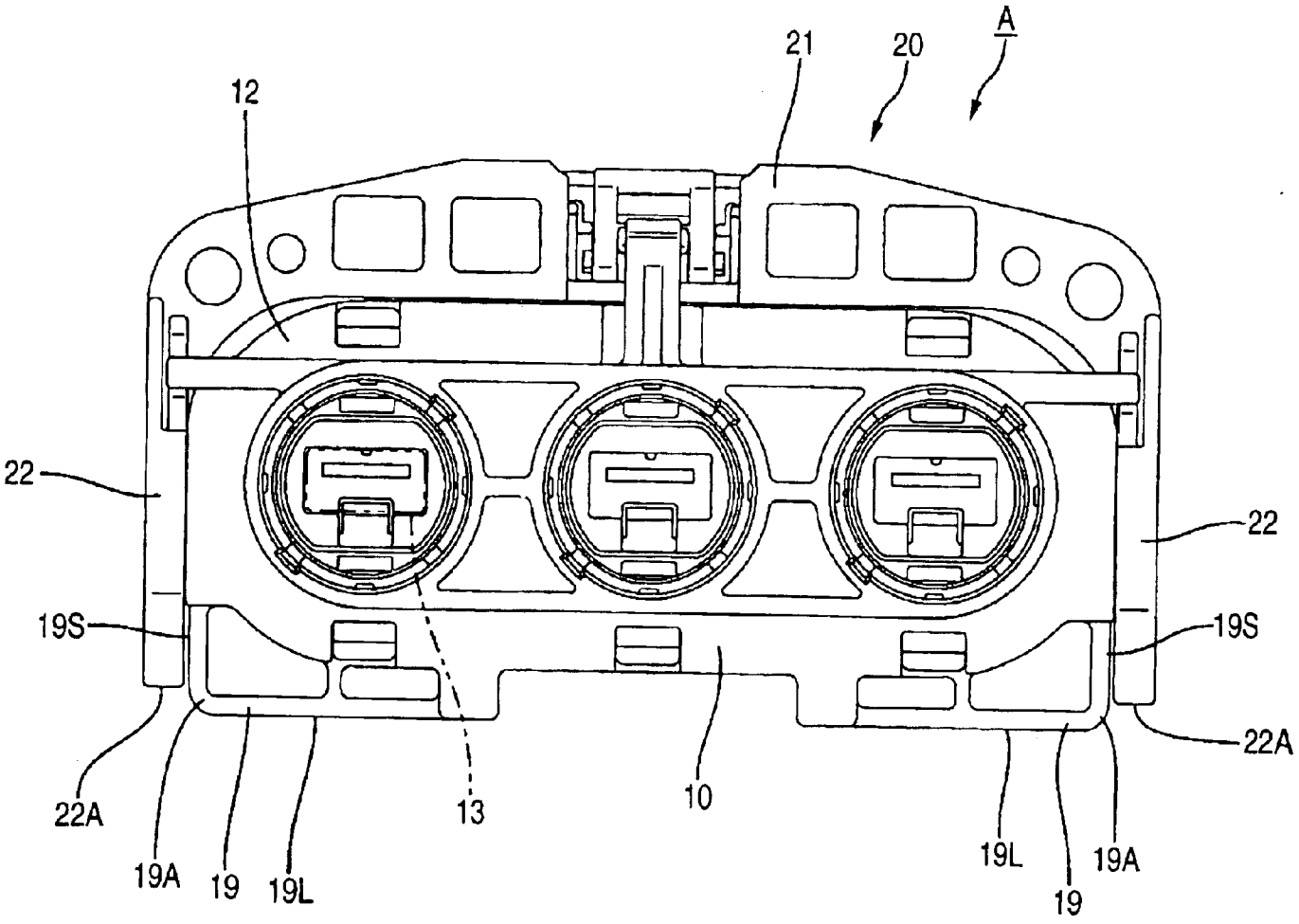
FIG. 4 is a back view of the embodiment 1.
Figure 5:
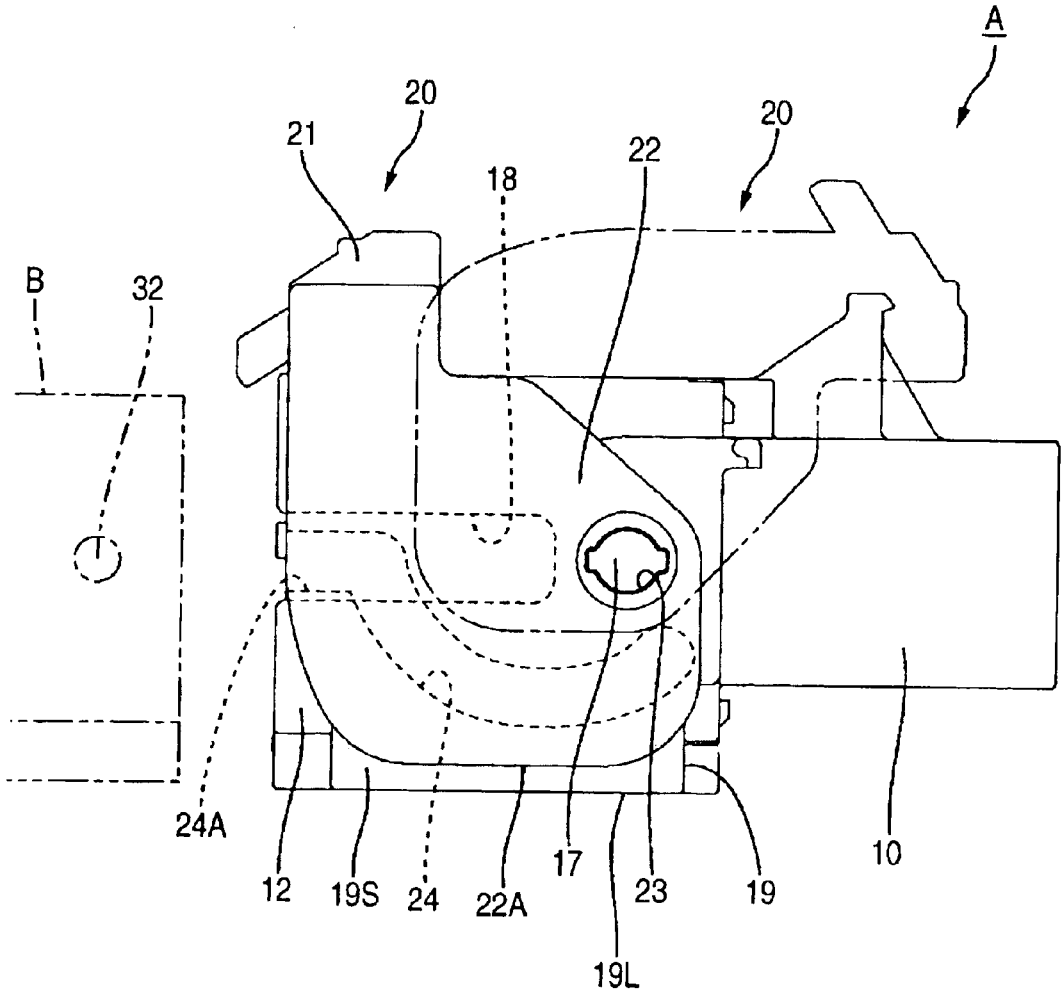
FIG. 5 is a side view of the embodiment 1.
Figure 6:
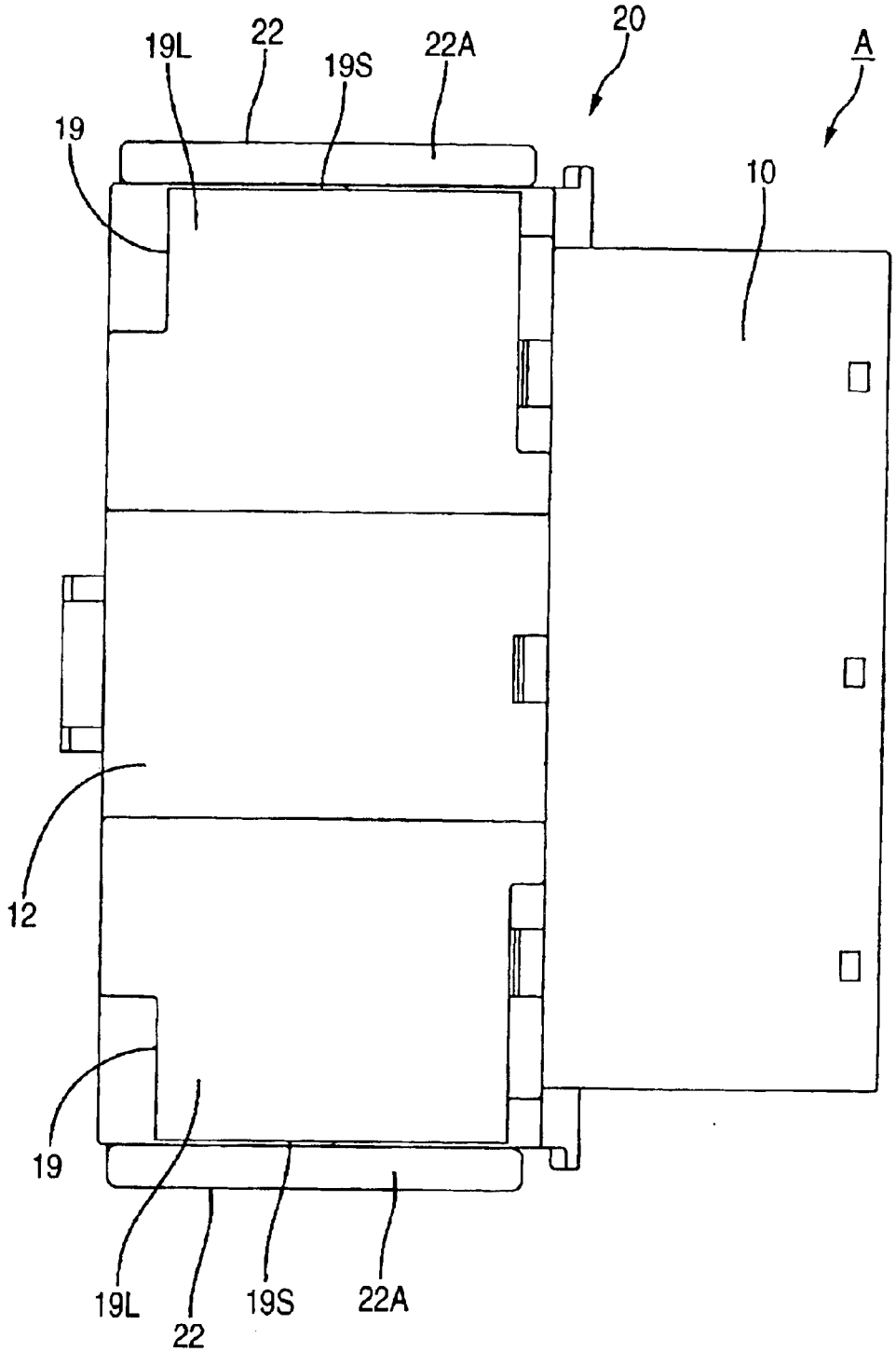
FIG. 6 is a bottom view of the embodiment 1.

To fit the lever-type connector A according to the present embodiment with the mating connector B, firstly, the lever 20 is rotated to its wait position, and the entrances 24A of the cam grooves 24 are not only opened forwardly (that is, in the direction that corresponds to the cam pins 32 of the mating connector B) but also held in the states thereof in which they correspond to the escape grooves 18 of the hood parts 12 (see FIG. 3). In this state, the lever-type connector A is moved nearer to the mating connector B, the cam pins 32 are respectively moved into the entrances 24A of their associated cam grooves 24, and the hood parts 12 are slightly fitted with the outer surface of the mating connector B. In case where the lever 20 is rotated from this state, due to the engagement between the cam grooves 24 and cam pins 32, the lever-type connector A is drawn close to the mating connector B.

In the fitting process, there are produced three kinds of frictional resistance: that is, frictional resistance which is caused by the elastic sliding contact between the shield shells 14 and 31; frictional resistance caused by the elastic sliding contact between the seal rings 16 and the inner peripheries of the fitting recessed portions; and, frictional resistance caused by the elastic sliding contact between the female-terminal metal members 13 and male-terminal metal members (see FIG. 3). These three kinds of frictional resistance provide obstacles to the smooth fitting operation. However, due to a cam action (leverage) through the engagement between the cam grooves 24 and cam pins 32 attained by the rotational movement of the lever 20, even in case where the operation force of the lever 20 is small, the fitting operation of the two connectors A and B can be advanced smoothly. By the way, to remove the two connectors A and B, the above-mentioned procedure may be executed in reverse (the detailed description thereof is omitted here). In this case as well, due to the cam action (leverage), the two connectors A and B can be smoothly removed from each other with a small operation force.

Now, in the lever-type connector A according to the present embodiment, in a state where the lever 20 is rotated to the wait position, projecting end portions 22A, which are provided on and projected from the operation portions 21 of the arm parts 22, face downward. That is, the operation parts 21 are situated upwardly of the bearing holes 23 and support shafts 17, whereas the projecting end portions 22A are situated downwardly of the bearing holes 23 and support shafts 17. Also, the projecting end portions 22A not only extend almost linearly in the back-and-forth direction but also are almost flush with the lower surface of the hood part 12. And, since the hood part 12 is formed in an elliptic shape, when it is viewed from the front surface thereof, as shown in FIG. 3, an arc-shaped area existing downwardly of the center of rotation of the lever 20 in the hood part 12 parts downward away from the arm parts 22, that is, in the horizontal direction (in the right and left direction) with respect to the arm parts 22.

Therefore, in the operation to fit the lever-type connector A with the mating connector B, when an operator carelessly slips his or her hand to thereby drop the lever-type connector A down onto a drop surface G, in case where the dropping posture of the lever-type connector A is inclined right or left, the downwardly facing projecting end portions 22A of the arm parts 22 collide with the drop surface G and thus the drop impact due to the weights of the lever-type connector A and electric wires connected to the female-terminal metal members 13 is all applied to the arm parts 22. In this case, there is a fear that the lever 20 can be broken or the lever 20 can be removed from the support shafts 17.

In view of the above, according to the present embodiment, there are taken the following measures. That is, in the right and left end portions of the lower surface of the hood part 12 of the connector housing 10, there are formed impact receive portions 19 which, in a state where the lever 20 is present at the wait position, are projected downwardly of the projecting end portions 22A of the arm parts 22. Also, each of the impact receive portions 19 is formed in a shape which fills up a clearance between the projecting end portion 22A of the arm part 22 and the outer surface of the hood part 12; and, therefore, in a state where the lever 20 is present at the wait position, the flat-shaped outer surfaces 19S of the impact receive portions 19 are opposed to the inner surfaces of the arm parts 22 with few clearance between them. Also, the lower surfaces 19L of the impact receive portions 19 are formed flush and continuous with the lower surface of the hood part 12.

Due to this structure, in case where the lever-type connector A drops down while the lever 20 is present at the wait position and the projecting end portions 22A of the lever 20 face downward, the lower surfaces 19L of the flat plates of the impact receive portions 19 firstly collide with the drop surface G, so that most of the drop impact of the lever-type connector A is received by the impact receive portions 19. Also, as shown in FIG. 3, in case where the dropping posture of the lever-type connector A is inclined in the right or left direction as well, one of the right and left impact receive portions 19 collides with the drop surface G; and, in this case as well, most of the drop impact is received by the present impact receive portion 19. By the way, in this case, more specifically, the corner edge portion 19A of the present impact receive portion 19, which is a connecting portion between the lower surface 19L and outer side surface 19S of the present impact receive portion 19, collides with the drop surface G. That is, in case where the lever-type connector A drops down substantially in the same posture as the posture thereof when it is fitted with the mating connector B (in the position where the projecting end portions 22A of the arm parts 22 face substantially downward), the arm parts of the lever 20 can be prevented from colliding with the drop surface and thus the drop impact of the lever-type connector A can be hardly applied onto the projecting portions 22A of the arm parts 22.

Also, in case where the lever-type connector A drops down onto the drop surface G, there is the following fear: that is, after the impact receive portions 19 collide with the drop surface G once, the lever-type connector A jumps up; and, when the lever-type connector A drops down onto the drop surface G again, the projecting end portions 22A of the arm parts 22 can be butted against the drop surface G, or the projecting end portions 22A of the arm parts 22 can be butted against other members (not shown) existing on the drop surface G. However, in the present embodiment, since the outer side surfaces 19S of the impact receive portions 19 are disposed adjacent and opposed to the inner surfaces of the projecting end portions 22A of the arm parts 22, even in case where the projecting end portions 22A of the arm parts 22 are going to flex toward the outer surface sides of the connector housing 10 (hood part 12), at the time when the projecting end portions 22A are flexed slightly, the projecting end portions 22A are contacted with the outer side surfaces 19S of the impact receive portions 19, so that the projecting end portions 22A are prevented from flexing greatly. Also, because the clearances respectively existing between the projecting end portions 22A of the arm parts 22 and the outer side surfaces of the hood part 12 are filled up by their respective impact receive portions 19, there is no fear that the projecting end portions 22A of the lever 20 can be flexed greatly toward the hood part 12. Therefore, the lever 20 can be prevented against breakage or can be prevented against removal from the connector housing 10 due to the flexed projecting end portions 22A.

Embodiment 2

Figure 7:
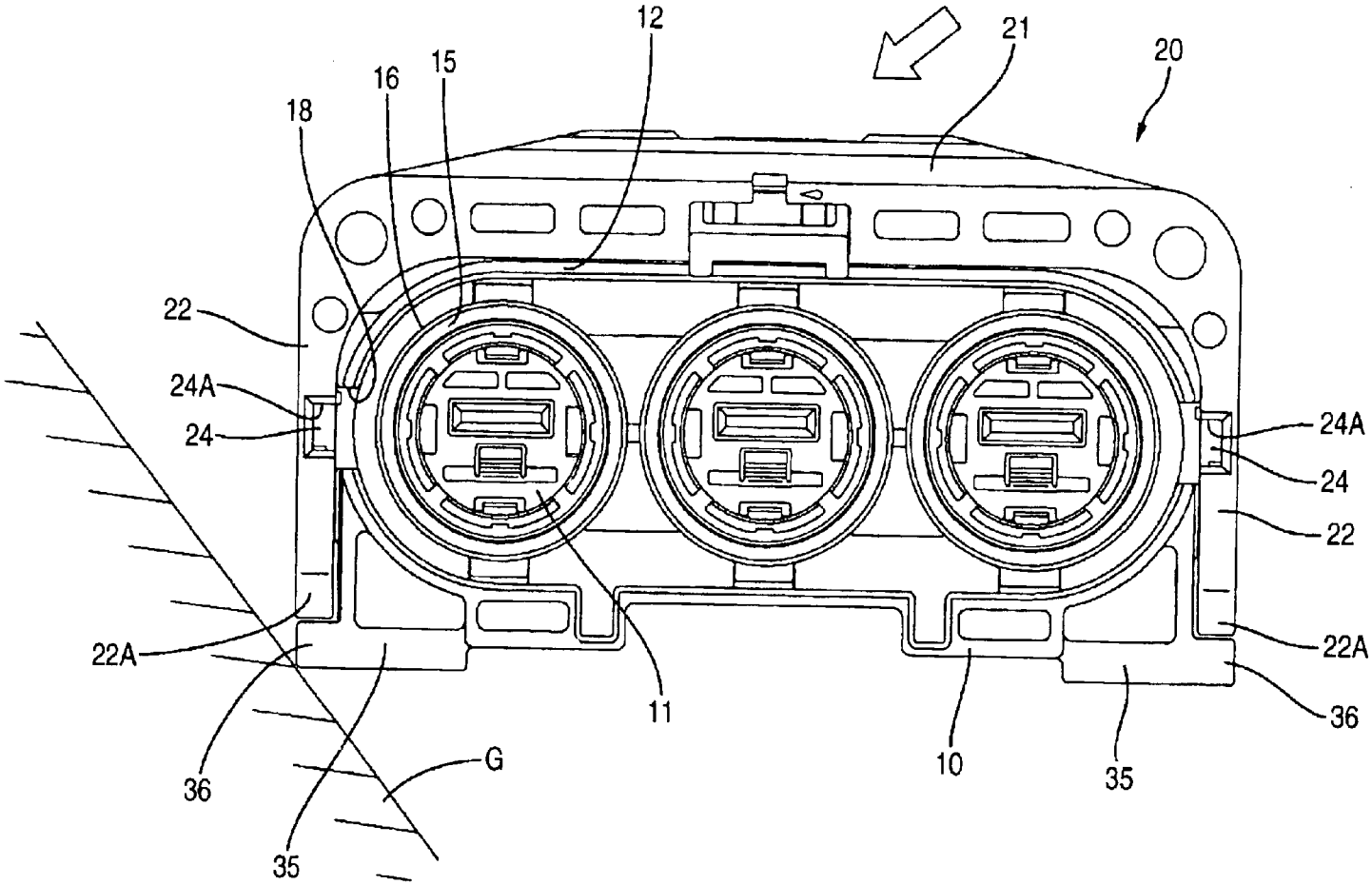
FIG. 7 is a front view of another embodiment 2 of a lever-type connector according to the invention.
Figure 8:
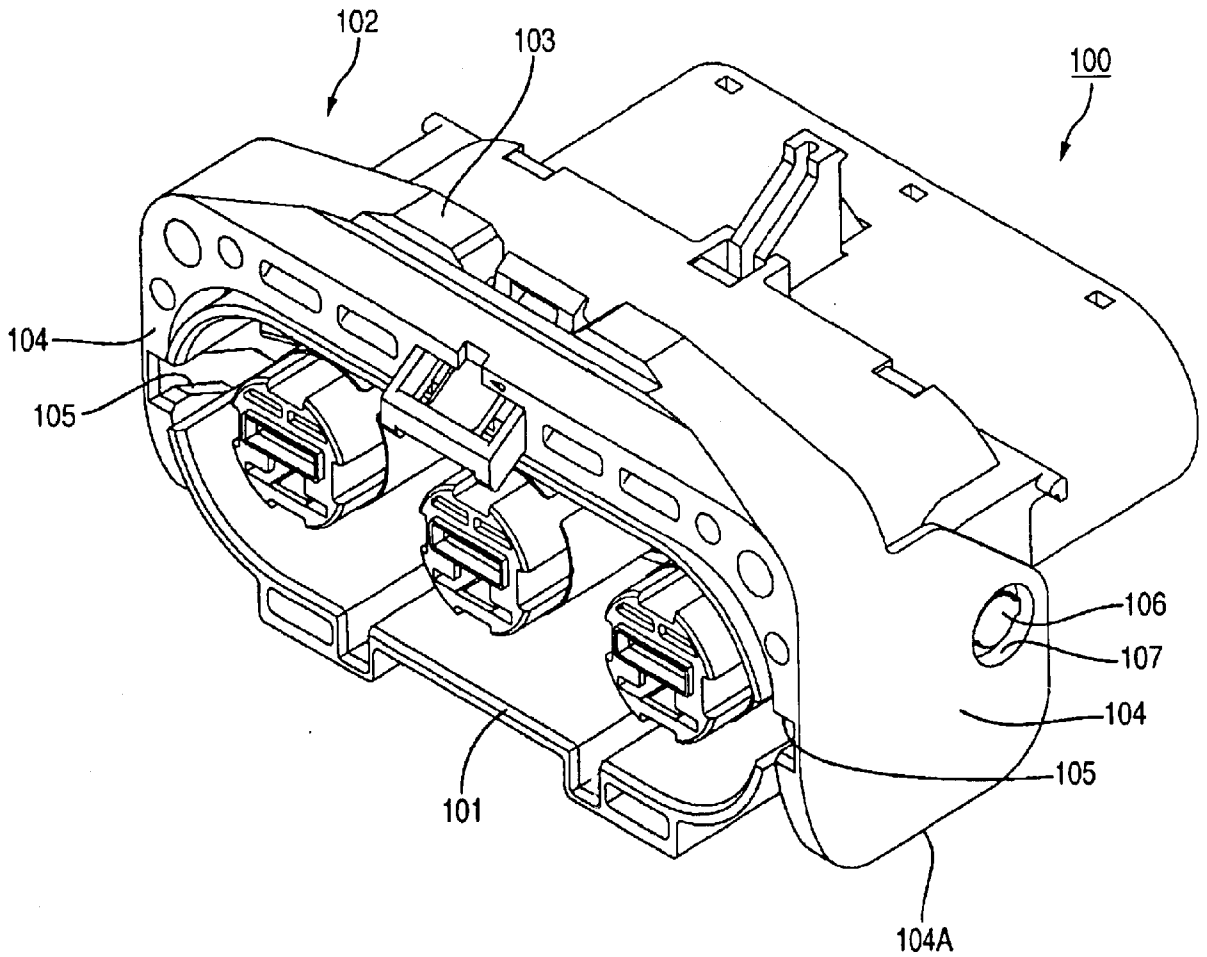
FIG. 8 PRIOR ART
FIG. 8 is a perspective view of a conventional lever-type connector.
Figure 9:
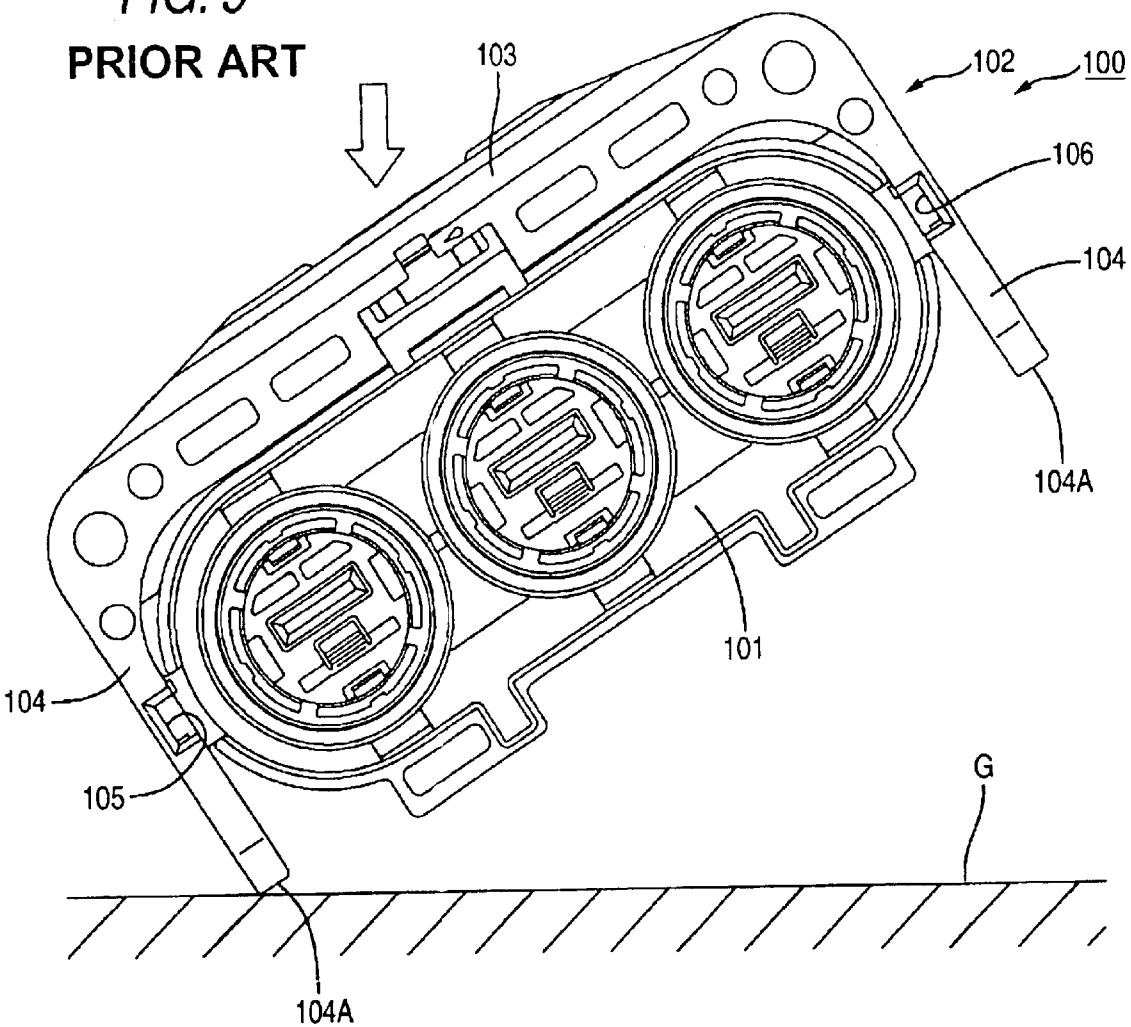
FIG. 9 PRIOR ART
FIG. 9 is a front view of the above conventional lever-type connector.

Next, description will be given below of a second embodiment of a lever-type connector according to the invention with reference to FIG. 7.

The present embodiment is different from the above-mentioned first embodiment 1 in the structure of the impact receive portions 35 thereof. The remaining portions of the present embodiment are the same as those of the embodiment 1. Therefore, the same parts of the present embodiment are given the same designations and thus the description of the structures, operations and effects thereof is omitted here.

The impact receive portions 35 in the present embodiment 2 are respectively formed in the two right and left end portions of the lower surface of the hood part 12 and, in a state where the lever 20 is situated at the wait position, are projected downwardly of the projecting end portions 22A of the arm parts 22. Also, in the impact receive portions 35, there are respectively formed protection portions 36 which extend outwardly in the horizontal direction, while the protection portions 36 are respectively disposed adjacent and opposed to the lower edges of the projecting end portions 22A of the arm parts 22. The impact receive portions 35, similarly to the impact receive portions 19 according to the embodiment 1, fill up clearances respectively existing between the projecting end portions 22A of the arm parts 22 and the outer side surfaces of the hood part 12; and, the flat-shaped outer surfaces 35S of the impact receive portions 35 are opposed to the inner surfaces of the arm parts 22 with little clearance between them.

Since the impact receive portions 35 according to the present embodiment 2 include the protection portions 36, even in case where the angle of inclination of the inclined posture of the lever-type connector B when it drops down is larger than in the embodiment 1, the projecting end portions 22A of the arm parts 22 can be positively prevented against collision with the drop surfaces G.

Other Embodiments

The present invention is not limited to the embodiments explained in the above description with reference to the accompanying drawings but, for example, the following embodiments also fall within the technical scope of the invention. Further, besides the following embodiments, various changes and modifications are also possible without departing from the scope of the appended aspects.

(1) In the illustrated embodiments, the impact receive portions are formed so as to fill up the clearances respectively existing between the outer side surfaces of the connector housing and the projecting end portions of the arm parts. However, according to the invention, the impact receive portions can also be provided at and projected from positions relatively adjacent to the projecting end portions of the arm parts in such a manner that the clearances between the connector housing and the arm parts are not filled up by the impact receive portions but remain as they are.

(2) In the illustrated embodiments, description has been given of the lever-type connector having a waterproof function and a shield function. However, the invention can also apply to a lever-type connector having one of a waterproof function and a shield function, or a lever-type connector having neither a waterproof function nor a shield function.

(3) In the illustrated embodiments, the impact receive portions are formed so as to be adjacent and opposed to the inner surfaces of the projecting end portions of the arm parts. However, according to the invention, the impact receive portions can also be formed such that they have relatively large clearances with respect to the projecting end portions of the arm parts.

(4) In the illustrated embodiments, the impact receive portions are formed so as to fill up the clearances between the projecting end portions of the arm parts and the outer side surfaces of the connector housing (hood part). However, according to the invention, the impact receive portions can also be formed so as not to fill up the clearances respectively existing between the projecting end portions of the arm parts and the outer side surfaces of the connector housing (hood part).

What is claimed is:

1. A lever-type connector comprising:

a lever including an operation part and a pair of arm parts respectively extended from ends of said operation part and substantially to a lower surface of a connector housing, said arm parts of said lever being supported respectively on right and left outer side surfaces of a said connector housing, said lever being rotatable between a wait position and an engaged position, the lever extending in a first direction transverse to a longitudinal axis of the connector when in the wait position and extending in a second direction substantially parallel to the longitudinal axis when in the engaged position, cam grooves with entrances respectively formed in said arm parts, said entrances being opened toward a mating connector and facing in a direction substantially perpendicular to the first direction when the lever is in the wait position, to enable cam pins of the mating connector to move thereinto, and impact receive portions which, in a state where said lever is in said wait position, project beyond projecting end portions of said arm parts, in the right and left end portions near the lowest surface of said connector housing, wherein said impact receive portions are formed to fill up clearances existing respectively between said projecting end portions of said arm parts and outer side surfaces of said connector housing.

2. The lever-type connector as set forth in claim 1, wherein said impact receive portions are formed to be adjacent and opposed to inner surfaces of said projecting end portions of said arm parts.

3. The lever-type connector as set forth in claim 1, wherein a lower surface of said impact receive portions is formed flush with said lower surface of said connector housing.

4. The lever-type connector as set forth in claim 1, wherein said impact receive portions includes side and bottom surfaces connected to said connector housing and creating an open space between said connector housing and side and bottom surfaces, and a protection portion extending outwardly from respective ones of said impact receive portions and under respective ones of said arm parts.

5. The lever-type connector as set forth in claim 1, wherein said lever is rotated upwardly and rearwardly when fitting said lever-type connector with said mating connector.

6. The lever-type connector as set forth in claim 1, wherein said impact receive portions include side and bottom surfaces that are oriented at about 90 degrees relative to each other, and wherein said arm parts are adjacent to said side surface of said impact receive portions.

7. A combination, including:

the lever-type connector as set forth in claim 1, and a mating connector that mates with the lever-type connector.

8. The lever-type connector as set forth in claim 1, wherein said connector housing includes a hood portion having an oval shape.

9. The lever-type connector as set forth in claim 1, wherein said impact receive portions are located on the opposite side of said connector housing from said lever at said wait position.

10. A lever-type connector comprising:

a lever including an operation part and a pair of arm parts respectively extended from ends of said operation part, said arm parts of said lever being supported respectively on right and left outer side surfaces of a connector housing, said lever being rotatable between a wait position and an engaged position, the lever extending in a first direction transverse to a longitudinal axis of the connector when in the wait position and extending in a second direction substantially parallel to the longitudinal axis when in the engaged position, cam grooves with entrances respectively formed in said arm parts, said entrances being opened toward a mating connector and facing in a direction substantially perpendicular to the first direction when the lever is in the wait position, to enable cam pins of the mating connector to move thereinto, and impact receive portions which, in a state where said lever is in said wait position, project beyond projecting end portions of said arm parts, in the right and left end portions of a lower surface of said connector housing, wherein said impact receive portions are formed to fill up clearances existing respectively between said projecting end portions of said arm parts and outer side surfaces of said connector housing, and wherein said impact receive portions include side and bottom surfaces that meet each other at about 90 degrees.

11. A lever-type connector comprising:

a lever including an operation part and a pair of arm parts respectively extended from ends of said operation part and substantially to a lowest surface of a connector housing, said arm parts of said lever being supported respectively on right and left outer side surfaces of a connector housing, said lever being rotatable between a wait position and an engaged position, the lever extending in a first direction transverse to a longitudinal axis of the connector when in the wait position and extending in a second direction substantially parallel to the longitudinal axis when in the engaged position, cam grooves with entrances respectively formed in said arm parts, said entrances being opened toward a mating connector and facing in a direction substantially perpendicular to the first direction when the lever is in the wait position, to enable cam pins of the mating connector to move thereinto, and impact receive portions which, in a state where said lever is in said wait position, project beyond projecting end portions of said arm parts, in the right and left end portions of a lower surface of said connector housing, wherein said impact receive portions are formed to fill up clearances existing respectively between said projecting end portions of said arm parts and outer side surfaces of said connector housing, wherein said impact receive portions includes side and bottom surfaces connected to said connector housing and creating an open space between said connector housing and side and bottom surfaces, and wherein said connector housing includes a hood portion having an oval shape.

* * * * *